US007748585B2

(12) United States Patent
Shek

(10) Patent No.: US 7,748,585 B2
(45) Date of Patent: Jul. 6, 2010

(54) AUTOMATIC SENSING AND OUTPUTTING DEVICE FOR AN OBJECT

(76) Inventor: Michael Shek, P.O.Box 44-2049, Taipei (TW) 10668

( * ) Notice: Subject to any disclaimer, the term of this patent is extended or adjusted under 35 U.S.C. 154(b) by 560 days.

(21) Appl. No.: 11/649,771

(22) Filed: Jan. 5, 2007

(65) Prior Publication Data

US 2008/0164368 A1 Jul. 10, 2008

(51) Int. Cl.
*B65H 16/02* (2006.01)
*B65H 23/18* (2006.01)

(52) U.S. Cl. ..... 225/14; 225/10; 242/579; 242/590; 242/564.1

(58) Field of Classification Search ..... 225/10, 225/14, 17, 18; 83/648–650; 242/564, 654.1, 242/564.3, 564.4, 565, 579, 580, 566, 590
See application file for complete search history.

(56) References Cited

U.S. PATENT DOCUMENTS 4,071,200 A * 1/1978 Stone ..... 242/564
4,796,825 A * 1/1989 Hawkins ..... 242/564
4,807,824 A * 2/1989 Gains et al. ..... 242/560.1
5,054,675 A * 10/1991 Taves ..... 225/20
5,312,021 A * 5/1994 Nelson ..... 222/183
6,820,785 B2 * 11/2004 Kapiloff ..... 225/14
6,830,210 B2 * 12/2004 Formon et al. ..... 242/563
2005/0109789 A1 * 5/2005 Nagayoshi ..... 221/32

* cited by examiner

*Primary Examiner*—Kenneth E. Peterson
*Assistant Examiner*—Phong Nguyen
(74) *Attorney, Agent, or Firm*—Banger Shia

(57) ABSTRACT

An automatic sensing and outputting device for an object mainly includes a housing, a control portion and an output unit. The housing has a surface on which a fixing rod is disposed, and accommodates a driving mechanism. The control portion is disposed at a predetermined position in the housing. A control circuit board in the control portion includes a sensor and a zeroing sensor for object output sensing. The output unit includes a reel, which engages with and moved by the driving mechanism in the housing, and a pressing plate, which normally and slightly presses against the reel through an elastic member.

16 Claims, 7 Drawing Sheets

AUTOMATIC SENSING AND OUTPUTTING DEVICE FOR AN OBJECT

BACKGROUND OF THE INVENTION (1) Field of the Invention

The invention relates to an automatic sensing and outputting device, and more particularly to a device capable of automatically sensing an output length of an object.

(2) Description of the Prior Art

A reel of paper is placed in a present roller-type paper dispensing device, and a cutter is disposed at a paper output portion of the device. A reel of toilet paper may be pulled to a paper output portion of the paper dispensing device after a user goes to the toilet and wants to use the toilet paper. The user may pull the toilet paper by a suitable length and then tear the paper by the cutter in a very convenient manner.

However, the conventional design still has some drawbacks to be improved. When a new reel of toilet paper is provided to replace the old reel of toilet paper in the well-known paper dispensing device, the whole reel of toilet paper is tighter because the quantity of the new reel of toilet paper is larger (or the outer diameter thereof is larger). The reel of toilet paper cannot be easily rolled when it is firstly used. On the contrary, when the toilet paper is consumed to a predetermined extent (the outer diameter is decreased), the reel of toilet paper is looser in the device. So, a lot of toilet paper may be pulled out and wasted when the user slightly pulls the toilet paper.

Thus, the roller-type paper dispensing device capable of overcoming the problem of manual paper output has been disclosed in, for example, Taiwan Patent Number TW350313, entitled "AUTOMATIC SENSING AND PAPER DISPENSING DEVICE FOR A TOILET PAPER DISPENSING DEVICE". The automatic sensing and paper dispensing device can automatically sense the wound toilet paper and dispense a constant quantity of toilet paper by providing the automatic sensing and paper dispensing device, a motor and a gear set in the housing.

However, the overall structure design problem of the automatic sensing and paper dispensing device causes the paper output port to be located at the bottom end of the housing of the device. So, this type of automatic sensing and paper dispensing device is only suitable for being hung on the wall and cannot be placed on a table and used in conjunction with other wound objects such as a paper towel or a cling film. This is one of the drawbacks in the structure design. Furthermore, the outputted toilet paper is forced to output by reversing the paper dispensing roller and the pressing roller, so the used toilet paper becomes denser (or harder) by the forced rolling of the rollers. This phenomenon causes the rough feeling when the toilet paper is wiped or the toilet paper may even hurt the skin.

SUMMARY OF THE INVENTION

The invention mainly provides a dual-use automatic sensing and outputting device for a wound object, wherein the device may be placed on a table or hung on a wall.

Another object of the invention is to provide an automatic sensing and outputting device capable of zeroing a torn object, which has a smaller length or a larger length, and outputting a free end of the object to a predetermined location, so that the object is always kept at a predetermined use length.

Still another object of the invention is to provide an automatic sensing and outputting device for a wound object, wherein the device can prevent the paper, which is rolled and outputted by rollers, from becoming hard or dense to influence the comfortable feeling of use.

The automatic sensing and outputting device capable of achieving the above-mentioned objects includes a housing, a control portion and an output unit. A fixing rod to be surrounded by a wound object is disposed on a surface of the housing. A driving mechanism is disposed in the housing. The control portion is disposed at a predetermined location in the housing. A control circuit board is disposed in the control portion. A sensor and a zeroing sensor for sensing an output of the object are disposed on the control circuit board. The output unit includes a reel engaging with and driven by the driving mechanism in the housing, and a pressing plate, which normally and slightly presses against the reel using an elastic member. Thus, the automatic sensing and outputting device for the object can achieve the above-mentioned objects.

Further aspects, objects, and desirable features of the invention will be better understood from the detailed description and drawings that follow in which various embodiments of the disclosed invention are illustrated by way of examples.

DETAILED DESCRIPTION OF THE PREFERRED EMBODIMENTS

Figure 1:
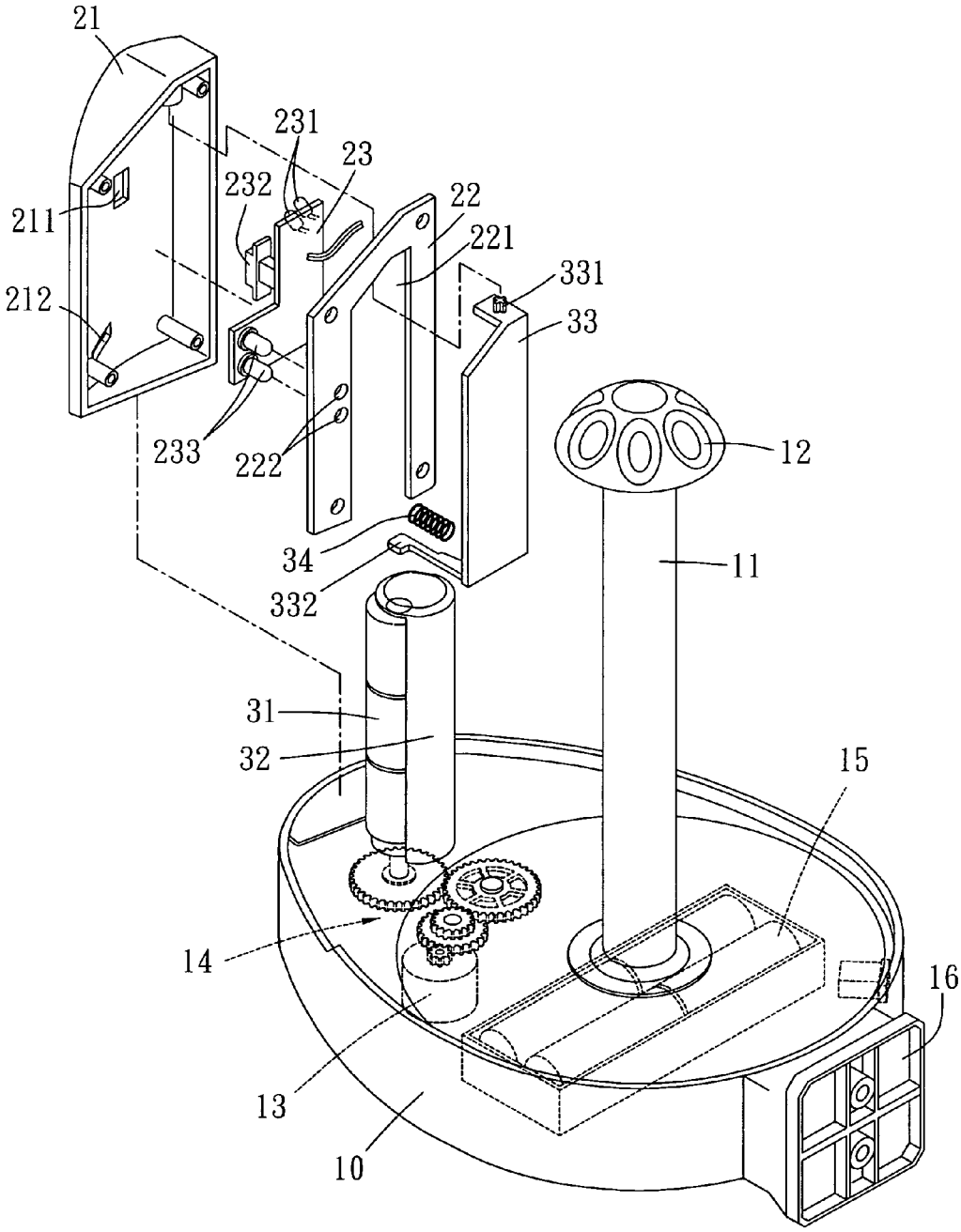
FIG. 1 is an exploded view showing a structure of the invention.
Figure 2:
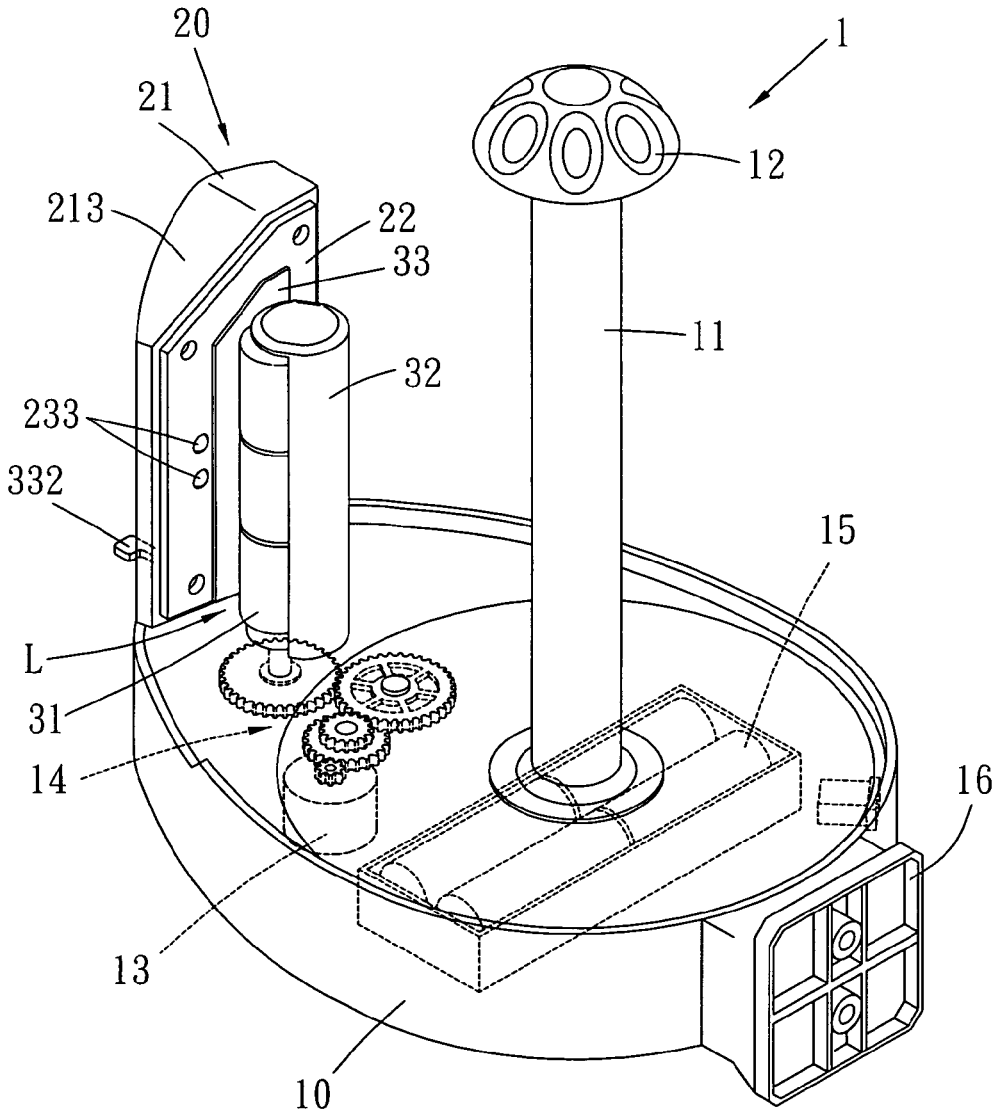
FIG. 2 is a pictorially internal view showing the structure of the invention.
Figure 3:
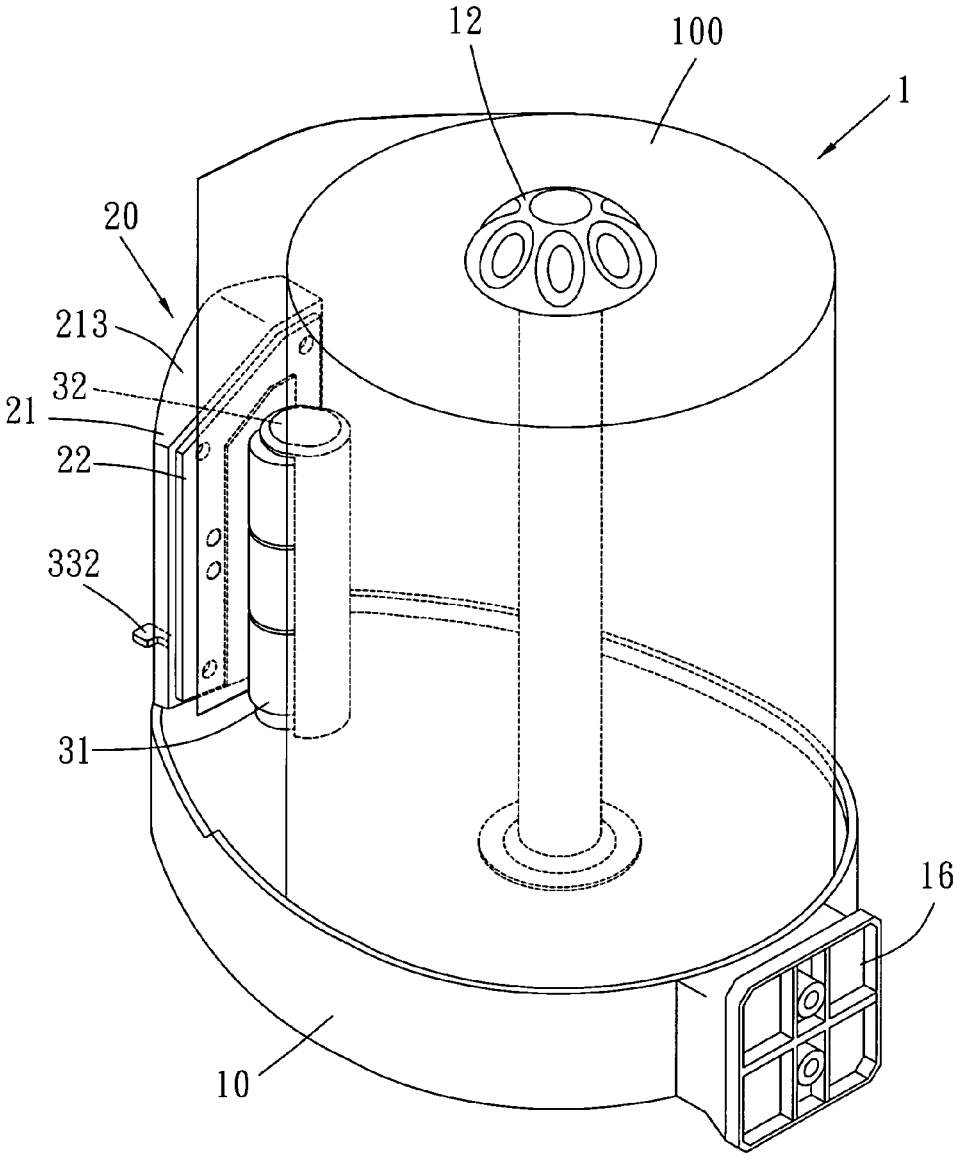
FIG. 3 shows a state of the invention used in conjunction with wound toilet paper.

The invention mainly relates to an automatic sensing and outputting device for an object, wherein the used object may be a wound object including toilet paper, a paper towel, an aluminum foil, a cling film or a plastic film. In order to make the effect of the detailed structure of the invention clearer, the most-frequently used toilet paper will be illustrated as an example without limiting the protected scope of the invention to the single toilet paper.

Referring to FIGS. 1 to 4, an automatic sensing and outputting device 1 of the invention mainly includes a housing 10, a control portion 20 and an output unit.

A fixing rod 11 extends from a middle of a surface of the housing 10 in a direction perpendicular to the surface. After a top positioning cover 12 of the fixing rod 11 is removed, wound toilet paper 100 may be disposed to surround the fixing rod 11. A driving mechanism is disposed in the housing 10. The driving mechanism includes a motor 13 and a gear set 14. A DC power supply 15 in the form of a battery is disposed in the housing 10 to provide the voltage source for the operation of the driving mechanism. In addition, a rectangular hanging portion 16 extends from one side of the housing 10 so that the automatic sensing and outputting device 1 can be fixed to or movably hang on a wall through the hanging portion 16 in addition to being directly placed on a table through a bottom surface of the housing 10.

Figure 4:
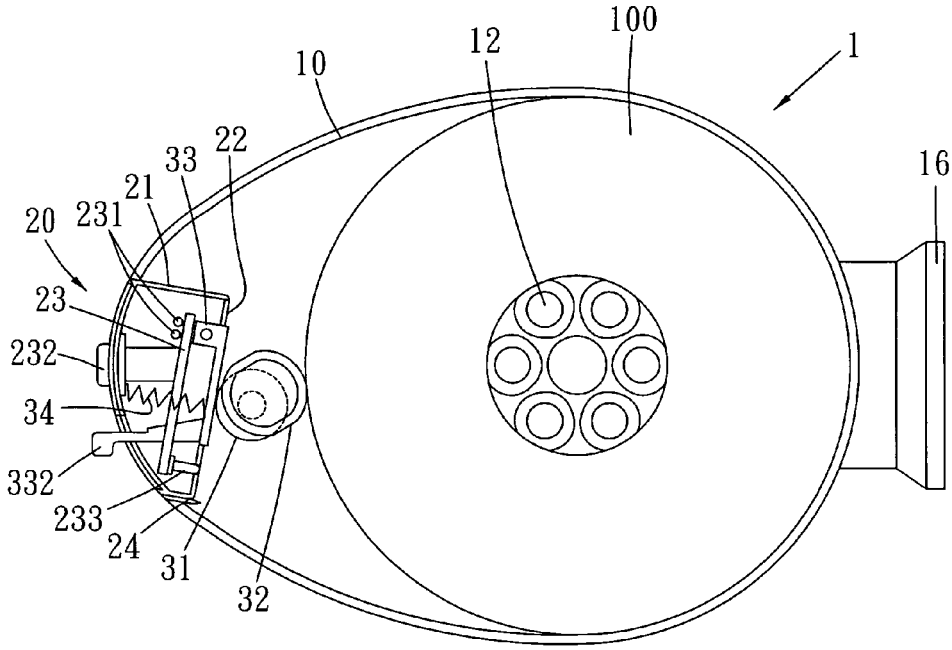
FIG. 4 is a top view showing the structure of FIG. 3.
Figure 5:
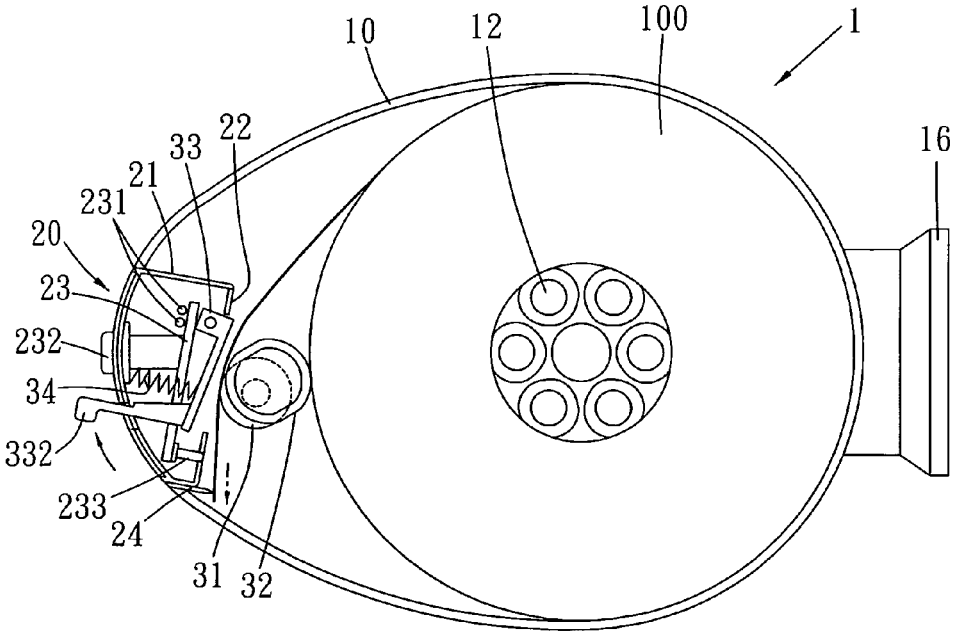
FIG. 5 is a schematic illustration showing an operation of installing a starting end of the wound toilet paper into an output device according to the invention.

The control portion 20 is disposed in a tip end portion of the housing 10 and includes a frame 21 having a predetermined depth, a frame cover 22 for covering an open end of the frame 21, and a control circuit board 23 accommodated within a space surrounded by the frame 21 and the frame cover 22. A rectangular opening 211 and a slim actuating lever guiding hole 212 are formed at predetermined locations of the frame 21. A sloped guiding sensing area 213 is formed on a top of the frame 21. The middle of the frame cover 22 is formed with a longitudinal accommodating hole 221. One side of the accommodating hole 221 is formed with two through holes 222 arranged in a vertical direction. In addition, a sensor 231 for sensing the existence of the user is disposed on the control circuit board 23 facing the frame 21. The sensor 231 may sense the existence of the user through the sloped guiding sensing area 213 on the top of the frame 21. A stage adjusting knob 232 is disposed on a lateral side of the control circuit board 23. The stage adjusting knob 232 may be accommodated within and positioned in the rectangular opening 211 and slight projects beyond the frame 21. A zeroing sensor 233 is disposed on the control circuit board 23 facing the frame cover 22. The zeroing sensor 233 passes through and is positioned in the two through holes 222 on the lateral side of the frame cover 22 for the purpose of zeroing the forwarding or reversing paper with different specifications. Thus, it is advantageous to the subsequent process of automatically sensing and controlling the outputted toilet paper to be located at the predetermined tearing line, so that the user can tear the paper conveniently. Of course, in order to facilitate the smoothness of tearing the paper and the flatness of the torn paper, a cutting portion 24, which may be a cutting sheet, may be disposed at the output end of the control portion 20 facing the toilet paper 100, as shown in FIGS. 4 and 5.

The output unit mainly receives the message of the sensor 231 and automatically outputs the toilet paper 100. The output unit includes a reel 31 and a pressing plate 33.

The roller-type reel 31 is disposed perpendicular to the surface of the housing 10, and faces the frame cover 22 of the control portion with a gap therebetween. The bottom end of the reel 31 engages with the motor 13 through the gear set 14 so that the operating driving mechanism can rotate the reel 31. In order to prevent the finger from being jammed unintentionally by the rotating reel 31 to cause an accident, an anti-entrapping cover 32 is disposed on a lateral side of the reel 31 to prevent the accident from occurring.

The pressing plate 33 corresponds to the shape of the accommodating hole 221 of the frame cover 22. A platform extends from the top end of the pressing plate 33 toward the frame 21. A top end of the platform is formed with a projecting pivot 331, and an actuating lever 332 extends from a bottom end of the platform in the same direction. The pressing plate 33 inserting into the accommodating hole 221 is pivotally mounted on the top end of the frame 21 through the pivot 331 of the platform on the top end. The actuating lever 332 on the bottom end of the pressing plate 33 passes through the actuating lever guiding hole 212. An elastic member 34 in the form of a compression spring is combined between the pressing plate 33 and the frame 21 to enable one end of the normal pressing plate 33 to slightly project beyond the frame cover 22 and to slightly press against the reel 31, as shown in FIG. 4.

In the automatic sensing and outputting device 1 for the object according to the invention, the fixing rod 11, the output device and the housing 10 are longitudinal and perpendicular to each other. So, the size of the automatic sensing and outputting device 1 can be greatly reduced. Furthermore, the output device and the housing 10 are disposed perpendicular to each other so that the toilet paper 100 can be outputted laterally. Thus, the housing 10 having the horizontal bottom surface can be placed on the table and used in conjunction with a paper towel, a cling film, an aluminum foil or a plastic film. In addition, the housing 10 can be hung on the wall through the hanging portion 16 on one side of the housing 10. So, the device can become a dual-use device.

In addition, another advantage of the invention will be described with reference to FIGS. 4 and 5. After the fixing rod 11 is surrounded by the toilet paper 100, the starting end of the wound toilet paper 100 only has to developed and rolled toward the output unit, and the exposed actuating lever 332 penetrating through the actuating lever guiding hole 212 has to be actuated so that the pressing plate 33 pressed by the elastic member 34 can be pressed inward, as shown in FIG. 5. Thus, the gap between the reel 31 and the pressing plate 33 is enlarged so as to facilitate the starting end of the toilet paper 100 to smoothly go out. Also, when the actuating lever 332 is released, the pressing plate 33 elastically pressed by the elastic member 34 can press the toilet paper against the reel 31 to facilitate the transmission output. Of course, when the toilet paper 100 is being outputted, one reel 31 and one pressing plate 33 clamp the toilet paper 100 bi-directionally, and the pressing plate 33 itself has the buffer resilience property through the elastic member 34. So, the rotating reel 31 provides a pressing force to the toilet paper 100 to achieve the positioning and guiding effects, and the conventional problem caused in the conventional bi-directional rollers for forcing the paper to become hard (dense) can be eliminated. Thus, the outputted toilet paper 100 still has the original soft property.

The control circuit board 23 of the invention can sense whether the user exists to achieve the automatic paper output effect through the sensor 231, and provides the correct output switching efficiency according to the length of the tearing line of the placed toilet paper 100 using the stage adjusting knob 232, wherein the typical gap of the tearing line of the paper ranges from 16 to 18 cm or 26 to 28 cm. In addition, the zeroing sensor 233 on the control circuit board 23 further provides the advanced effect.

Figure 7:
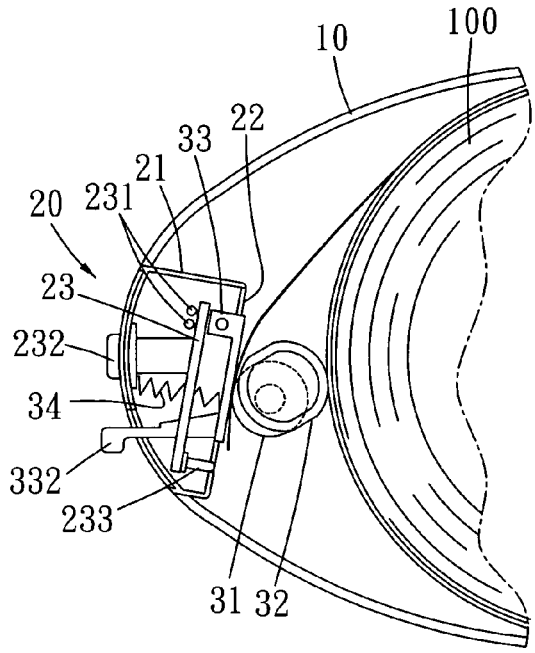
FIG. 7 shows a state that a torn portion of the toilet paper does not reach a predetermined location according to the invention.
Figure 8:
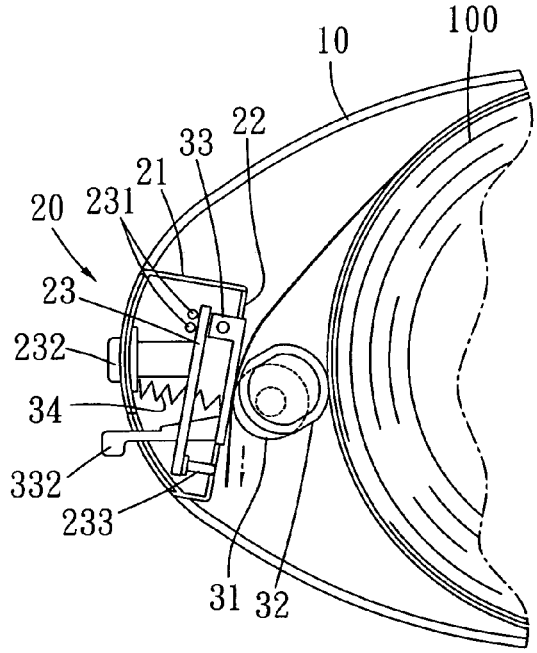
FIG. 8 is a schematic illustration showing that the invention is rolled to a default zeroing position state.

As shown in FIG. 7, when the user tears the used toilet paper 100 and makes the starting end of the toilet paper 100 not reach the position of the zeroing sensor 233 yet, the zeroing sensor 233 cannot sense the sheet and thus transmits a signal to the control circuit board 23 to enable the driving mechanism to rotate the reel 31 of the output device to roll the toilet paper 100 such that the too-short starting end is moved to the predetermined sensing position of the zeroing sensor 233, as shown in FIG. 8. Thus, the predetermined length of the torn toilet paper can be kept precisely every time.

Figure 9:
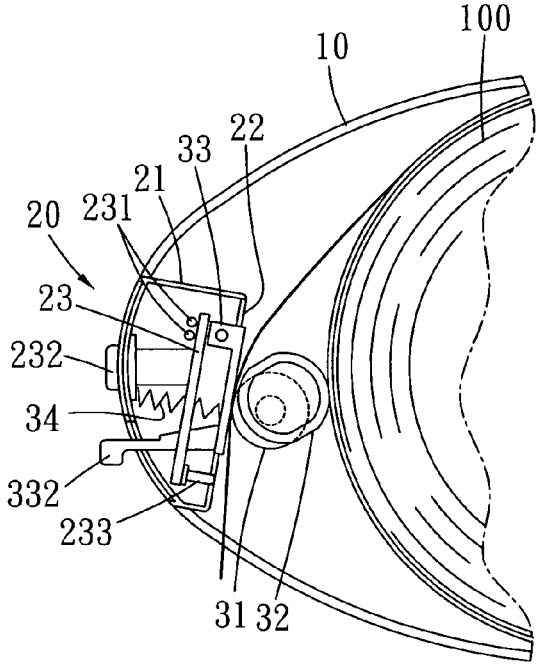
FIG. 9 shows a state that the torn portion of the toilet paper exceeds the predetermined location according to the invention.
Figure 10:
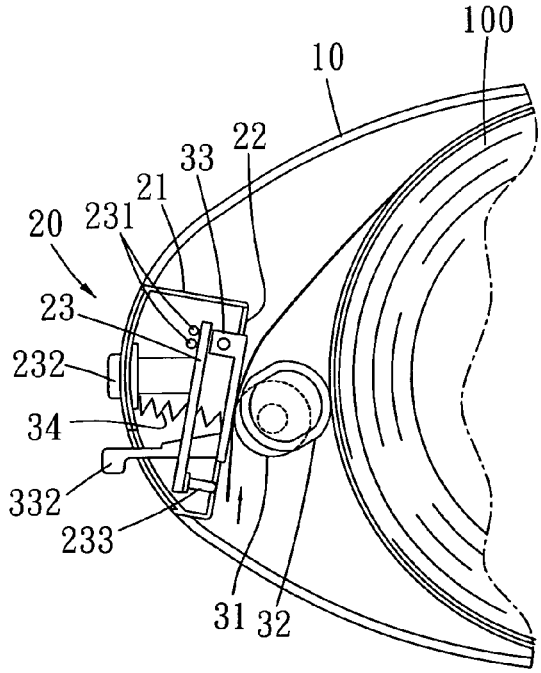
FIG. 10 is a schematic illustration showing that the exceeded torn portion of the toilet paper is rolled back to the default zeroing position state according to the invention.

In addition, as shown in FIG. 9, when the user tears off the used toilet paper 100 and the starting end of the toilet paper 100 exceeds the predetermined position, the zeroing sensor 233 transmits a sense signal to the control circuit board 23 to drive the output unit to reverse so as to wind the too-long paper to predetermined sensing position of the zeroing sensor 233 automatically, as shown in FIG. 10. Similarly, the predetermined length of the torn toilet paper also can be kept precisely every time.

Figure 6:
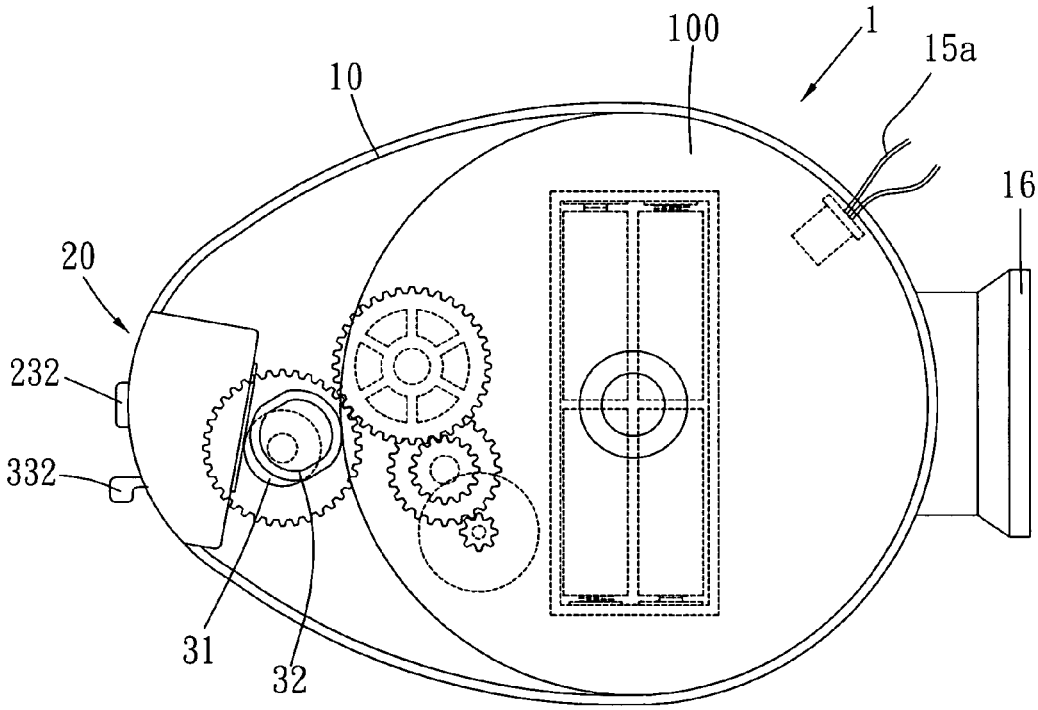
FIG. 6 is a schematic illustration showing the structure of the invention connected to another power supply.

New characteristics and advantages of the invention covered by this document have been set forth in the foregoing description. It is to be expressly understood, however, that the drawings are for the purpose of illustration only and are not intended as a definition of the limits of the invention. Changes in methods, shapes, structures or devices may be made in details without exceeding the scope of the invention by those who are skilled in the art. The scope of the invention is, of course, defined in the language in which the appended claims are expressed. For instance, the voltage source for powering the driving mechanism of FIG. 6 may also have an AC power supply 15*a* used in conjunction with a plug.

What is claimed is:

1. An automatic sensing and outputting device for an object, the device mainly comprising:

a housing having a surface on which a fixing rod to be surrounded by the object is disposed, wherein a driving mechanism for generating power through a power supply is disposed in the housing;

a control portion disposed at a predetermined position in the housing, wherein a control circuit board is disposed in the control portion, and the control circuit board comprises an operator sensor for sensing an operator and a zeroing sensor for sensing an output of the object;

an output unit comprising a reel and a pressing plate, wherein the reel is disposed on the surface of the housing and engages with the driving mechanism so as to be rotated by the driving mechanism, and the pressing plate normally and slightly presses against the reel using an elastic member;

wherein the control portion comprises a frame and a frame cover both accommodating the control circuit board, an actuating lever guiding hole is formed in the frame to accommodate an actuating lever attached to the pressing plate, a sensing area is formed on a top end surface of the frame near the operator sensor, the frame cover is longitudinally formed with an accommodating hole for accommodating the pressing plate, and one side of the accommodating hole is formed with two through holes through which the zeroing sensor passes.

2. The device according to claim 1, wherein the driving mechanism comprises a motor and a gear set engaging with the motor and the reel.

3. The device according to claim 1, wherein the power supply is a DC power supply accommodated within the housing.

4. The device according to claim 1, wherein the housing has a hanging portion.

5. The device according to claim 1, wherein a positioning cover is disposed on a top end of the fixing rod to limit the object, which is wound and surrounds the fixing rod, and the wound object comprises toilet paper, a paper towel, an aluminum foil, a cling film or a plastic film.

6. The device according to claim 1, wherein an anti-entrapping cover is disposed on one side of the reel.

7. The device according to claim 1, wherein an actuating lever is disposed at a bottom end of the pressing plate.

8. The device according to claim 1, wherein a cutting portion is disposed at a distal end of the control portion.

9. The device according to claim 8, wherein the cutting portion is a cutting sheet.

10. An automatic sensing and outputting device for an object, the device mainly comprising:

a housing having a surface on which a fixing rod to be surrounded by the object is disposed, wherein a driving mechanism for generating power through a power supply is disposed in the housing;

a control portion disposed at a predetermined position in the housing, wherein a control circuit board is disposed in the control portion, and the control circuit board comprises an operator sensor for sensing an operator and a zeroing sensor for sensing an output of the object;

an output unit comprising a reel and a pressing plate, wherein the reel is disposed on the surface of the housing and engages with the driving mechanism so as to be rotated by the driving mechanism, and the pressing plate normally and slightly presses against the reel using an elastic member;

wherein a bottom end of the pressing plate extends an actuating lever passing through an actuating lever guiding hole, and the control circuit board further has a stage adjusting knob, which passes through a frame rectangular opening and is to be switched;

wherein the control portion comprises a frame and a frame cover both accommodating the control circuit board, the frame rectangular opening and the actuating lever guiding hole are formed in the frame, a sensing area is formed on a top end surface of the frame near the operator sensor, the frame cover is longitudinally formed with an accommodating hole for accommodating the pressing plate, and one side of the accommodating hole is formed with two through holes through which the zeroing sensor passes.

11. The device according to claim 10, wherein the driving mechanism comprises a motor and a gear set engaging with the motor and the reel.

12. The device according to claim 10, wherein the power supply is a DC power supply accommodated within the housing.

13. The device according to claim 10, wherein the housing has a hanging portion.

14. The device according to claim 10, wherein a positioning cover is disposed on a top end of the fixing rod to limit the object, which is wound and surrounds the fixing rod, and the wound object comprises toilet paper, a paper towel, an aluminum foil, a cling film or a plastic film.

15. The device according to claim 10, wherein an anti-entrapping cover is disposed on one side of the reel.

16. The device according to claim 10, wherein an actuating lever is disposed at a bottom end of the pressing plate.

* * * * *